US006686816B1

(12) United States Patent
Schallner

(10) Patent No.: US 6,686,816 B1
(45) Date of Patent: Feb. 3, 2004

(54) METHOD OF BALANCING THE BANDWIDTH OF A DUAL-MODE FILTER

(75) Inventor: Martin Schallner, Ludwigsburg (DE)

(73) Assignee: Marconi Communications GmbH, Backnang (DE)

( * ) Notice: Subject to any disclaimer, the term of this patent is extended or adjusted under 35 U.S.C. 154(b) by 0 days.

(21) Appl. No.: 10/088,367

(22) PCT Filed: Sep. 12, 2000

(86) PCT No.: PCT/IB00/01361

§ 371 (c)(1),
(2), (4) Date: Aug. 7, 2002

(87) PCT Pub. No.: WO01/20711

PCT Pub. Date: Mar. 22, 2001

(30) Foreign Application Priority Data

Sep. 14, 1999 (DE) ..... 199 43 958

(51) Int. Cl.[7] ..... H01P 1/20; H01P 3/08
(52) U.S. Cl. ..... 333/204; 333/178
(58) Field of Search ..... 333/178, 185, 333/204, 219

(56) References Cited

U.S. PATENT DOCUMENTS 5,703,546 A * 12/1997 Takahashi et al. ..... 333/204
6,326,865 B1 * 12/2001 Kundu et al. ..... 333/202

FOREIGN PATENT DOCUMENTS

JP 0573985 * 12/1993

OTHER PUBLICATIONS

*Experimental Investigation of DUal–Mode Microstrip Ring Resonators*, Proceedings of the Eueqopean Microwave Conference, GB, Turnbridge Wells, MEP, Bd. Conf. 20, M. Guglielmi, et al., Sep. 10, 1990, pp. 901–906.

*Stripline Dual–Mode Ring Resonators and Their Application to Microwave Devices*, IEEE Transactions on Microwave Theory and Techniques, U.S., IEEE Inc., New York, Yabuki Hiroyuki, et al., pp. 723–729, May 1, 1996.

* cited by examiner

*Primary Examiner*—Tuan T. Lam
(74) *Attorney, Agent, or Firm*—Kirschstein, et al.

(57) ABSTRACT

A method of balancing the bandwidth of a dual-mode filter, consisting of a ring resonator produced by microstrip technology, removes strip material in one or more places on the ring resonator where the first of the two modes of the ring resonator has a maximum current intensity, and in one or more additional places on the ring resonator, where the second mode has a maximum current intensity.

11 Claims, 1 Drawing Sheet

METHOD OF BALANCING THE BANDWIDTH OF A DUAL-MODE FILTER

PRIOR ART

Figure 1:
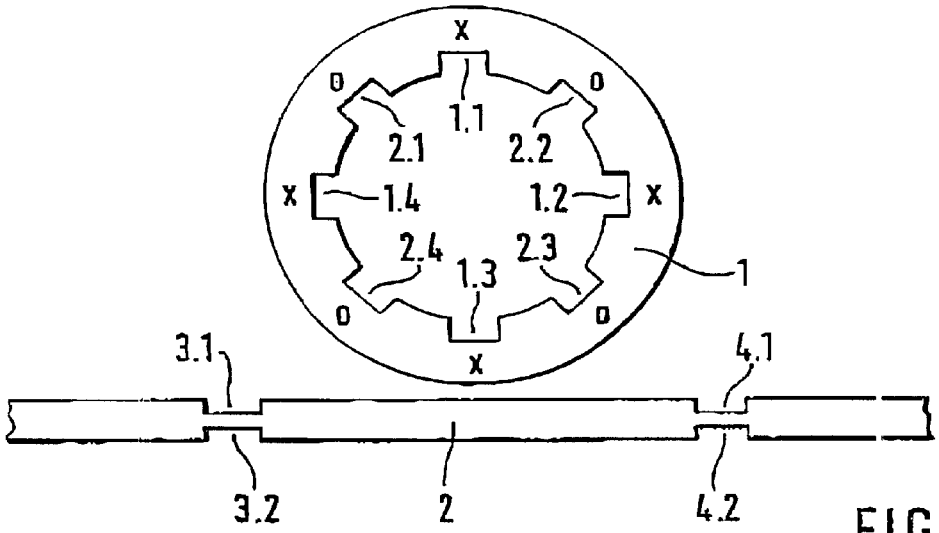

The present invention concerns a method for balancing the bandwidth of a dual-mode filter, consisting of a ring resonator produced by strip line technology.

A method for balancing the resonance frequency of a ring resonator is described in the older German Patent Application 198 21 382.4, in which line material is removed with a laser at one or more sites of the strip line ring until a desired resonance frequency is set. An additional strip line is coupled to the strip line ring, in which the resonance frequency of the filter can also be influenced by removing line material for narrowing of the conductor width. It follows from this older application that line material is removed at one or more sites of the strip line ring at which current maxima occur, in order to reduce the resonance frequency. Line material is removed on one or more sites of the strip line ring at which current minima occur, in order to increase the resonance frequency.

Narrow-band notch filters that suppress undesired residual signal of a local oscillator present in the transmitter of a microwave transceiver are required in transmission technology for numerous applications. These filters are supposed to have the highest possible stop-band attenuation in their stop-band range and the lowest possible pass-band attenuation in their pass-band regions, which lie at the frequency below and above the stop-band region. A relatively small transitional region between the pass-band and stop-band region is then desirable. Such notch filters can be produced in the form of ring resonators in strip line technology at very limited demands and cost effectively.

The underlying task of the invention is to provide a method of the type just mentioned, with which not only the resonance frequency of the dual-mode filter consisting of a ring resonator can be balanced, but also the filter bandwidth.

ADVANTAGES OF THE INVENTION

The mentioned task is solved with the features of claim 1 in that the width of the ring line is narrowed at one or more sites of the ring resonator, at which the first of the two modes of the ring resonator has a current maximum, and at one or more sites of the ring resonator, at which the second mode has a current maximum. Owing to the fact that the resonance frequencies of the two modes existing in the ring resonator are balanced separately from each other, it is possible to vary the bandwidth of the filter.

Advantageous modifications of the invention are apparent from the subclaims.

The ring resonator has a line length that corresponds to its average operating wavelength or a multiple of it, so that the two resonance modes existing in the ring resonator have the same resonance frequencies.

An additional strip line is preferably coupled to the ring resonator, via which the waves are coupled in and coupled out of the ring resonator. By changing the strip line width, the upper or lower filter flank can be made steeper, so that a narrower transition is produced between the stop-band region and the pass-band region of the filter on the correspondingly steepened flank. For steepening of the upper filter flank, the strip line can be narrowed at an interval of one-half wavelength, which corresponds to the average operating wavelength of the resonator, from the coupling site between the ring resonator and the strip line. It is then expedient to carry out narrowing on both sides of the coupling site, in each case at a spacing of a half-wavelength. Steepening of the lower filter flank is achieved by widening of the strip line at a spacing of a half-wavelength from the coupling site between the ring resonator and the strip line. The strip line is preferably widened on both sides of the coupling site, in each case at a spacing of a half-wavelength. The widening of the strip line can occur by bonding line pieces laterally onto the strip line.

Removal of the line material for line narrowing can be carried out simply by means of a laser.

DRAWING

Figure 2:
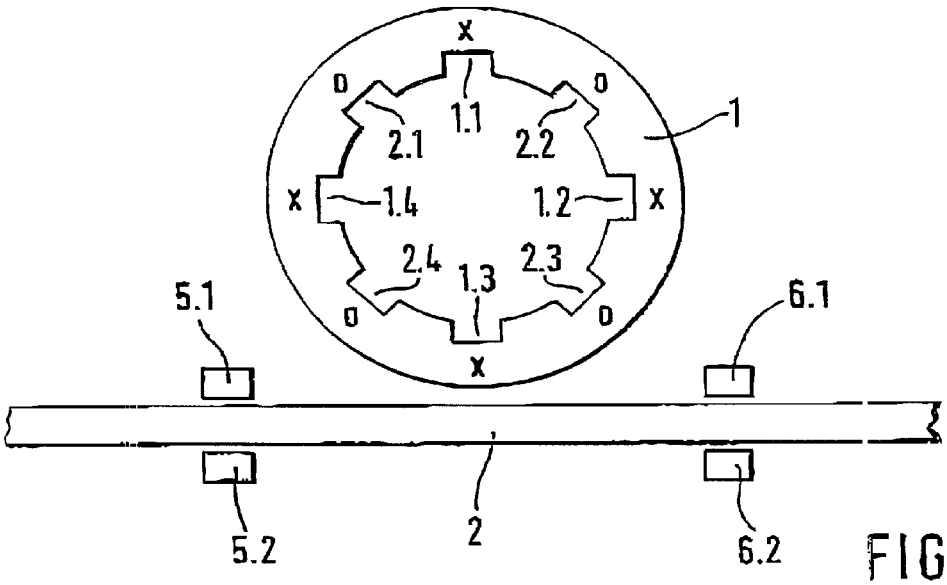

The invention is further explained below by means of two practical examples depicted in the drawing. In the drawing:

FIG. 1 shows a ring resonator with a coupled strip line, having narrowings of the line width, FIG. 2 shows a ring resonator with a coupled strip line, having widened sections.

DESCRIPTION OF PRACTICAL EXAMPLES

A ring resonator 1, designed as a strip line ring, is shown in FIG. 1. There are always two resonance modes in such a ring resonator. The ring resonator 1 has a length (which means the periphery of the circular center line of the ring resonator) of an even-number multiple of the average operating wavelength of the dual-mold filter produced by the ring resonator. The two modes are oriented orthogonal to each other; this means that the current maxima of one mode occur at the sites of the current minima of the other mode. The locations at which the first mode has current maxima are denoted x in the drawing on ring resonator 1, and the locations at which the second mode has current maxima are denoted o.

If a narrowing of the line width is now produced at the site of a current maximum of one mode on the strip line ring, the resonance frequency of this mode will be shifted to a lower frequency. A current minimum is situated with the other mode at the same site of the line narrowing, which means that the resonance frequency of this mode is slightly increased. The resonance frequencies of the two modes therefore cannot be fully adjusted independently of each other. However, the mutual effect is relatively limited. By line narrowings of the ring resonator 1 at one or more sites of the current maxima of the two modes, possibly by an iterative process of removing line material, their resonance frequencies can be deliberately set at the desired value. The filter can therefore be balanced at a certain middle frequency and the bandwidth of the filter can also be set at a desired value by the spacing of the resonance frequencies of the two modes.

It can be gathered from FIG. 1 that several spots of line material have been removed on the inside of ring resonator 1 or were already omitted during layout of the ring resonator. The removed/omitted spots 1.1, 1.2, 1.3 and 1.4 are situated at sites at which the first mode has current maxima and the spots 2.1, 2.2, 2.3, 2.4 are situated at sites at which the second mode has current maxima. Narrowing of the line width need not be carried out, as shown here, at each current maximum of the corresponding mode. The number of line narrowings depends on how far the resonance frequencies of the individual modes are to be shifted. The removal/omission of line material for narrowing of the line width can also additionally occur on the outside, in addition to the inside, or only on the outside of the ring resonator 1. Removal of line material on the inside of the ring resonator, however, has a stronger effect on the resonance frequency of the modes.

The straight strip line 2 is coupled to the ring resonator 1, which serves for coupling-in and coupling-out of waves into or from ring resonator 1. In the practical example depicted in FIG. 1, line material is removed at several spots 3.1, 3.2, 4.1 and 4.2 for narrowing of the line width, or line material is already omitted during layout. The spots 3.1, 3.2 and 4.1, 4.2 of material removal/omission are situated at a spacing of a half-wavelength from the coupling site between the ring resonator 1 and a strip line 2. The coupling site is the site at which the spacing between the ring resonator 1 and the strip line 2 is smallest. Wavelength means the average operating wavelength of the filter. The two line narrowings of the strip line 2 are produced, in the depicted practical example of FIG. 1, by removal/omission of spots 3.1 and 3.2 and 4.1 and 4.2 of the line material on both sides of the strip line 2. In order to narrow the conductor width, it is sufficient if the material is removed/omitted on only one side of the line. The described line narrowings act like additional series impedances, which cause steepening of the upper filter flank. Under some circumstances, it is also sufficient to produce only one series impedance by a single narrowing of strip line 2.

If the lower filter flank is to be steepened, this can be accomplished by adding at least one parallel admittance to the strip line 2. A parallel admittance for strip line 2 is produced by widening the strip line at a spacing of a half-wavelength from the coupling site between the ring resonator 1 and strip line 2. In the practical example of FIG. 2, line widenings are provided on both sides of the coupling site between the ring resonator 1 and the strip line 2, so that two parallel admittances are produced. Under practical conditions, these line widenings are produced by arranging, next to strip line 1, a line piece 5.1, 5.2 or 6.1, 6.2 on one side, or also on both sides, which can be contacted by bonding with strip line 2. Deviating from the practical example depicted in FIG. 2, several line pieces can be arranged in a row instead of one line piece, so that one has the possibility of connecting one or more line pieces together by bonding and a greater possibility of variation therefore exists for line widening. The line widenings can also be accomplished already during layout, as line pieces that are rigidly connected to line 2.

The removed/omitted spots 1.1, 1.2, 1.3, 1.4, 2.1, 2.2, 2.3, 2.4, 3.1, 3.2, 4.1, 4.2 and the added spots 5.1, 5.2, 6.1, 6.2 could have different shapes, for example, rectangular, round, triangular, etc. A greater effect on resonance frequency of the two modes can be exerted via the depth of the removed/omitted or added spots than via their widths. It is therefore expedient to carry out rough tuning of the resonance frequencies via the depth of the removed/omitted or added spots and fine tuning of the resonance frequencies via their width.

What is claimed is:

1. A method of balancing a bandwidth of a dual-mode filter having a ring resonator made of a strip having a width, the method comprising the step of: narrowing the width of the strip at a first site at which a first mode of the filter has a current maximum, and at a second site at which a second mode of the filter has a current maximum.

2. The method according to claim 1, wherein the first site includes a plurality of first zones.

3. The method according to claim 1, wherein the second site includes a plurality of second zones.

4. The method according to claim 1, wherein the strip has a strip length that corresponds to an average operating wavelength of the filter.

5. The method according to claim 4, wherein the strip length is a multiple of the average operating wavelength.

6. The method according to claim 1, and the step of coupling a strip line to the ring resonator, and the step of narrowing the strip line for steepening of an upper filter flank at a spacing of a half-wavelength that corresponds to an average operating wavelength of the filter.

7. The method according to claim 6, wherein the narrowing step is performed on both sides of the strip line at a spacing of the half-wavelength.

8. The method according to claim 1, and the step of coupling a strip line to the ring resonator, and the step of widening the strip line for steepening of a lower filter flank at a spacing of a half-wavelength that corresponds to an average operating wavelength of the filter.

9. The method according to claim 8, wherein the widening step is performed on both sides of the strip line at a spacing of the half-wavelength.

10. The method according to claim 8, wherein the widening step is performed by bonding additional line pieces.

11. The method according to claim 1, wherein the narrowing step is performed by a laser.

* * * * *